United States Patent [19]

Owen et al.

[11] 4,456,779

[45] Jun. 26, 1984

[54] CATALYTIC CONVERSION OF OLEFINS TO HIGHER HYDROCARBONS

[75] Inventors: Hartley Owen, Belle Mead; Susan K. Marsh, Mt. Holly; Bernard S. Wright, East Windsor, all of N.J.

[73] Assignee: Mobil Oil Corporation, New York, N.Y.

[21] Appl. No.: 488,834

[22] Filed: Apr. 26, 1983

[51] Int. Cl.[3] ..... C07C 3/03

[52] U.S. Cl. ..... 585/415; 585/315; 585/314; 585/322; 585/329; 585/413; 585/424

[58] Field of Search ..... 585/415, 412, 413, 424, 585/422, 423, 469, 315, 311, 314, 322, 329

[56] References Cited

U.S. PATENT DOCUMENTS

| | | | |
|---|---|---|---|
| 3,760,024 | 9/1973 | Cattanach et al. | 585/415 |
| 3,960,978 | 6/1976 | Givens et al. | 585/415 |
| 4,211,640 | 7/1980 | Garwood et al. | 585/415 |

*Primary Examiner*—Delbert E. Gantz

*Assistant Examiner*—A. Pal

*Attorney, Agent, or Firm*—A. J. McKillop; M. G. Gilman; L. G. Wise

[57] ABSTRACT

An improved continuous process for converting lower olefinic hydrocarbon feedstock to $C_5+$ liquid hydrocarbons by contacting vapor phase olefinic feedstream with acid zeolite catalyst in the presence of recycled diluent stream rich in $C_3$–$C_4$ hydrocarbons in an enclosed reactor at elevated temperature and pressure. The improved technique comprises a system for cooling reactor effluent to recover a heavier hydrocarbon stream containing a mixture of $C_3$–$C_4$ hydrocarbons and $C_5+$ hydrocarbons and debutanizing the heavier hydrocarbons below reactor pressure to obtain a $C_5+$ product stream and a condensed $C_3$–$C_4$ hydrocarbon stream. Operating efficiencies are realized in the heat exchange system by reboiling the debutanized $C_5+$ hydrocarbon product stream with hot reactor effluent, and by recycling and combining at least a portion of the condensed $C_3$–$C_4$ hydrocarbon stream to dilute liquid olefin hydrocarbon feedstock. By increasing pressure on the liquid olefinic hydrocarbon feedstock and liquid recycle stream to at least the elevated reactor pressure in the liquid state prior to vaporization, energy is conserved.

12 Claims, 5 Drawing Figures

CATALYTIC CONVERSION OF OLEFINS TO HIGHER HYDROCARBONS

FIELD OF INVENTION

This invention relates to processes and apparatus for converting olefins to higher hydrocarbons, such as gasoline-range or distillate-range fuels. In particular it relates to techniques for operating a multi-stage catalytic reactor system and downstream separation units to optimize heat recovery and product selectivity.

BACKGROUND OF THE INVENTION

Recent developments in zeolite catalysts and hydrocarbon conversion processes have created interest in utilizing olefinic feedstocks, such as petroleum refinery streams rich in lower olefins, for producing $C_5$+ gasoline, diesel fuel, etc. In addition to the basic work derived from ZSM-5 type zeolite catalysts, a number of discoveries have contributed to the development of a new industrial process, known as Mobil Olefins to Gasoline/Distillate ("MOGD"). This process has significance as a safe, environmentally acceptable technique for utilizing refinery streams that contain lower olefins, especially $C_2$–$C_5$ alkenes. This process may supplant conventional alkylation units. In U.S. Pat. Nos. 3,960,978 and 4,021,502, Plank, Rosinski and Givens disclose conversion of $C_2$–$C_5$ olefins, alone or in admixture with paraffinic components, into higher hydrocarbons over crystalline zeolites having controlled acidity. Garwood et al have also contributed improved processing techniques to the MOGD system, as in U.S. Pat. Nos. 4,150,062, 4,211,640 and 4,227,992. The above-identified disclosures are incorporated herein by reference.

Conversion of lower olefins, especially propene and butenes, over H-ZSM-5 is effective at moderately elevated temperatures and pressures. The conversion products are sought as liquid fuels, especially the $C_5$+ aliphatic and aromatic hydrocarbons. Olefinic gasoline is produced in good yield by the MOGD process and may be recovered as a product or recycled to the reactor system for further conversion to distillate-range products.

Olefinic feedstocks may be obtained from various sources, including fossil fuel processing streams, such as gas separation units, cracking of $C_2$+ hydrocarbons, coal byproducts, and various synthetic fuel processing streams. Cracking of ethane and conversion of conversion effluent is disclosed in U.S. Pat. No. 4,100,218 and conversion of ethane is aromatics over Ga-ZSM-5 is disclosed in U.S. Pat. No. 4,350,835. Olefinic effluent from fluidized catalytic cracking of gas oil or the like is a valuable source of olefins, mainly $C_3$–$C_4$ olefins, suitable for conversion according to the present MOGD process. Olefinic refinery streams which have been utilized in the past as feedstocks for alkylation processes may be advantageously converted to valuable higher hydrocarbons.

SUMMARY

The MOGD process is carried out at elevated temperatures and pressures, requiring significant investment in furnaces, heat exchange equipment, compressors and pumps for the various feed streams, effluent and intermediate streams. A continuous process has been designed to achieve these objectives for a multi-stage reactor system with an efficient heat exchange product recovery and recycle system. Advantageously, exothermic heat is recovered from the reactor effluent and utilized to heat a product fractionation liquid stream, such as a debutanizer reboiler stream. It has been found advantageous to provide a liquid lower alkane ($C_3$/$C_4$) and/or gasoline recycle stream as a diluent and to combine the liquid recycle and olefin feedstock at relatively lower pressure and pump the combined feedstream up to process pressure in the liquid phase. Substantial energy savings are achieved in this technique by single stage liquid pumping with subsequent heating to vaporize the combined olefinic feedstock and diluent stream prior to catalyst contact.

Accordingly it is an object of the present invention to provide a continuous system for converting lower olefins to higher hydrocarbons comprising methods and means for (a) combining a pressurized liquid olefinic feedstock containing a substantial fraction of lower olefins with a pressurized liquid lower alkane stream comprising a major fraction of $C_3$–$C_4$ alkanes;

(b) pre-heating the combined olefinic and lower alkane stream to a temperature of at least about 230° C.;

(c) contacting the pre-heated combined stream with an acid ZSM-5 type catalyst in a pressurized reactor zone to convert a major portion of the lower olefin fraction to $C_5$+ hydrocarbons in the gasoline boiling and distillate range;

(d) cooling the reactor effluent from step (c);

(e) debutanizing the cooled reactor effluent to recover a condensed lower alkane stream and a liquid $C_5$+ hydrocarbon stream; including heat exchanging the reactor effluent indirectly with the liquid $C_5$+ hydrocarbon stream in a debutanizer reboiler section;

(f) optionally recycling at least a portion of the condensed lower alkane stream to step (a);

(g) fractionating the $C_5$+ hydrocarbon stream to obtain a distillate product fraction and a gasoline-boiling range fraction; and (h) optionally recycling the gasoline fraction to step (a) for combining with the olefinic feedstream and lower alkane stream.

Advantageously, the olefinic stock consists essentially of $C_2$–$C_5$ aliphatic hydrocarbons containing a major fraction of monoalkenes in the essential absence of dienes or other deleterious materials. The process may employ various volatile lower olefins as feedstock, with oligomerization of $C_2$–$C_6$ $\alpha$-olefins being preferred for either gasoline or distillate production. Preferably the olefinic feedstream contains about 50 to 75 mole % $C_3$–$C_5$ alkenes.

In one aspect of the system, the pressure reactor zone comprises a plurality of operatively-connected catalytic reactors arranged in a multi-stage serial flow, with interstage cooling of reactor effluent in the debutanizer reboiler section. The debutanizer reboiler section may include a plurality of reactor effluent cooling tubes combined in a common kettle-type reboiler shell.

These and other objects and features of the novel MOGD system will be seen in the following description of the drawing.

THE DRAWING

DESCRIPTION OF PREFERRED EMBODIMENTS

Figure 1:
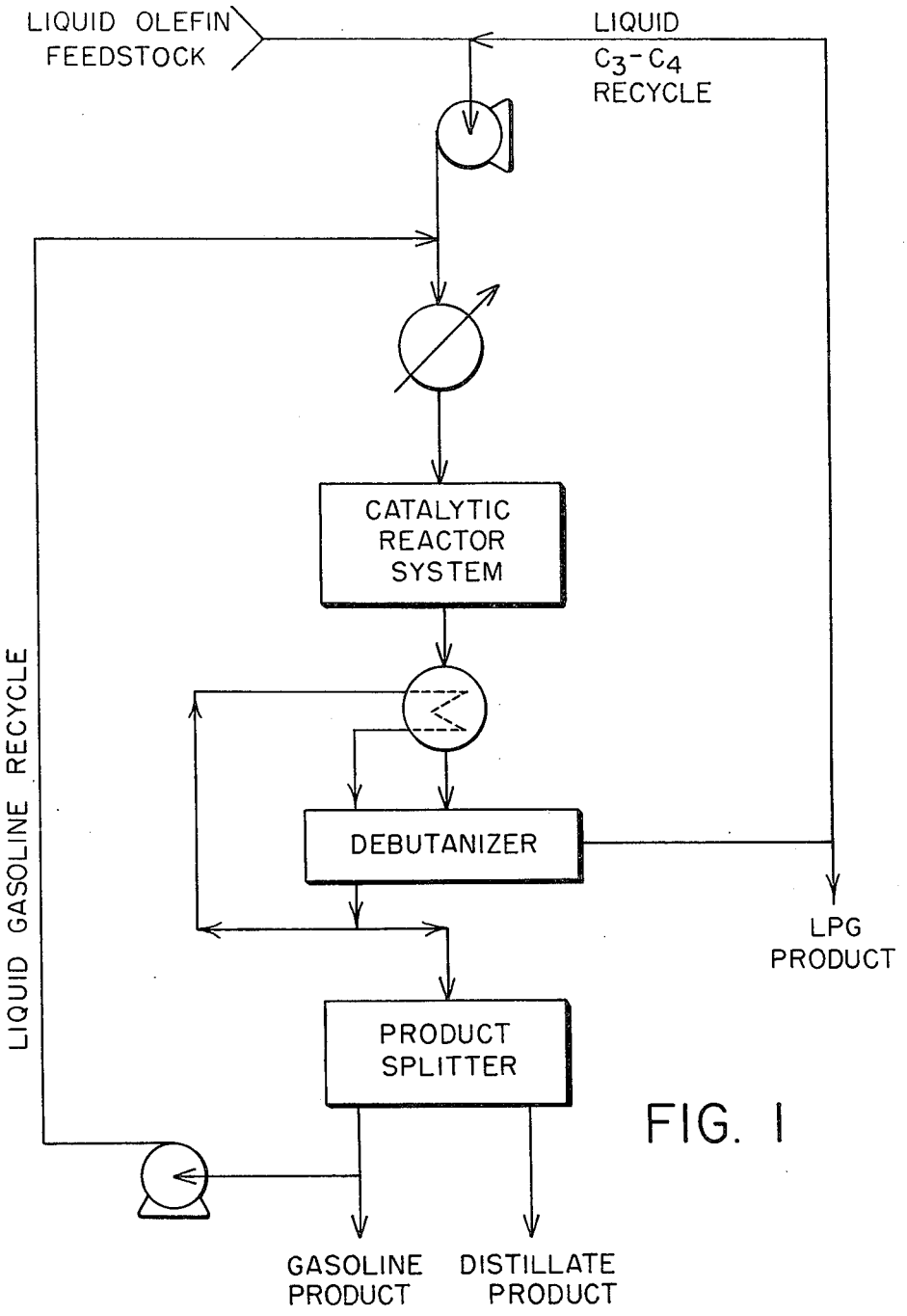
FIG. 1 is a simplified process flow diagram showing relationships between the major unit operations.

The flow diagram of FIG. 1 of the drawing represents the overall process. The olefinic feedstock is usually supplied as a liquid stream under moderate superatmospheric pressure and warm ambient temperature. Ordinarily, the feedstock is substantially below the process reactor pressure, and may be combined with recycled liquid diluent which is rich in $C_3$–$C_4$ alkanes at similar temperature and pressure. Following pressurization of the combined olefin-recycle and/or gasoline feedstreams, it is passed through the catalytic reactor system, which includes multiple fixed bed reactors operatively connected with the heat exchange system, as described later. The reactor effluent may be cooled by heat exchange with a debutanizer bottoms fraction. A condensed debutanizer overhead stream is recovered for recycle and the heavier hydrocarbons obtained by oligomerization of the feedstock is fractionated in a product splitter unit to yield a distillate fraction (330° F.+ boiling point) and a gasoline fraction (boiling range of 125° F. to 330° F.) in varying amount.

Since the gasoline product comprises a major fraction of unsaturated aliphatic liquid hydrocarbons, it may be recovered and hydrotreated to produce spark-ignited motor fuel if desired. Optionally, all or a portion of the olefinic gasoline range hydrocarbons from the splitter unit may be recycled for further conversion to heavier hydrocarbons in the distillate range. This may be accomplished by combining the recyle gasoline with lower olefin feedstock and diluent prior to heating the combined streams.

Process conditions, catalysts and equipment suitable for use in the MOGD process are described in U.S. Pat. Nos. 3,960,978 (Givens et al), 4,021,502 (Plank et al), and 4,150,062 (Garwood et al). Hydrotreating and recycle of olefinic gasoline are disclosed in U.S. Pat. No. 4,211,640 (Garwood and Lee). Other pertinent disclosures include U.S. Pat. No. 4,227,992 (Garwood and Lee) and U.S. patent application No. 108,617, filed Dec. 31, 1979 (Dwyer and Garwood) relating to catalytic processes for converting olefins to gasoline/distillate. The above disclosures are incorporated herein by reference.

Catalyst

The catalyst materials suitable for use herein are effective in oligomerizing lower olefins, especially propene and butene-1 to higher hydrocarbons. The unique characteristics of the acid ZSM-5 catalysts are particularly suitable for use in the MOGD system. Effective catalysts include those zeolites disclosed in U.S. patent application Ser. No. 390,099 filed June 21, 1982 (Wong and LaPierre) and Application Ser. No. 408,954 filed Aug. 17, 1982 (Koenig and Degnan), which relate to conversion of olefins over large pore zeolites. A preferred catalyst material for use herein is an extrudate (1.5 mm) comprising 65 weight % HZSM-5 (steamed) and 35% alumina binder, having an acid cracking activity ($\alpha$) of about 160 to 200.

The members of the class of crystalline zeolites for use in this invention are characterized by a pore dimension greater than about 5 Angstroms, i.e., it is capable of sorbing paraffins having a single methyl branch as well as normal paraffins, and it has a silica to alumina mole ratio of at least 12. Zeolite A, for example, with a silica to alumina ratio of 2.0, is not useful in this invention, and moreover it has no pore dimension greater than about 5 Angstroms.

The members of the class of crystalline zeolites for use herein constitute an unusual class of natural and synthetic minerals. They are characterized by having a rigid crystalline framework structure composed of an assembly of silicon and aluminum atoms, each surrounded by a tetrahedron of shared oxygen atoms, and a precisely defined pore structure. Exchangeable cations are present in the pores.

These zeolites induce profound transformations of substituted and unsubstituted aliphatic hydrocarbons to higher aliphatic or aromatic hydrocarbons in commercially desirable yields and are generally highly effective in condensing halo-hydrocarbons. Although they have usually low alumina contents, i.e, high silica to alumina mole ratios, they are very active even with silica to alumina mole ratios exceeding 30. This activity is surprising, since catalytic activity of zeolites is generally attributed to framework aluminum atoms and cations associated with these aluminum atoms. These zeolites retain their crystallinity for long periods in spite of the presence of steam even at high temperatures which induce irreversible collapse of the crystal framework of other zeolites, e.g. of the X and A type. Furthermore, carbonaceous deposits, when formed, may be removed by burning at higher than usual temperatures to restore activity. In many environments, the zeolites of this class exhibit very low coke forming capability, conducive to very long times on stream between burning regenerations.

An important characteristic of the crystal structure of this class of zeolites is that it provides constrained access to, and egress from, the intracrystalline free space by virture of having a pore dimension greater than about 5 Angstroms and pore windows of about a size such as would be provided by 10-membered rings of oxygen atoms. It is to be understood, of course, that these rings are those formed by the regular disposition of the tetrahedra making up the anionic framework of the crystalline zeolite, the oxygen atoms themselves being bonded to the silicon or ammonium atoms at the centers of the tetrahedra. Briefly, the preferred zeolites useful herein possess, in combination, a Constraint Index, as hereinafter defined, of about 1 to 12, a silica to alumina mole ratio of at least about 12, and a structure providing constrained access to the intracrystalline free space.

The silica to alumina mole ratio referred to may be determined by conventional analysis. This ratio is meant to represent, as closely as possible, the ratio in the rigid anionic framework of the zeolite crystal and to exclude aluminum in the binder or in cationic or other form within the channels.

Although such crystalline zeolites with a silica to alumina mole ratio of at least about 12 are useful, it is preferred to use zeolites having higher ratios of at least about 30. In some zeolites, the upper limit of silia to alumina mole ratio is unbounded, with values of 30,000 and greater, extending at least theoretically up to infinity. Therefore, the silica to alumina mole ratio of the zeolite for use herein may be from about 12 to infinity, preferably from about 30 to infinity. Such zeolites, after activation, acquire an intracrystalline sorption capacity for normal hexane which is greater than that for water, i.e, they exhibit "hydrophobic" properties. It is believd that this hydrophobic character is advantageous in the present invention.

The crystalline zeolites for use in this invention freely sorb normal hexane and have a pore dimension greater than about 5 Angstoms. In addition, their structure must provide constrained access to some larger molecules. It is sometimes possible to judge from a known crystal structure whether such constrained access exists. For example, if the only pore windows in a crystal are formed by 8-membered rings of oxygen atoms, then access by molecules of larger cross-section than normal hexane is substantially excluded and the zeolite is not of the desired type. Zeolites with windows of 10-member rings are preferred, although excessive puckering or pore blockage may render these zeolites substantially ineffective. Zeolites with windows of 12-membered rings do not generally appear to offer sufficient constraint to produce the advantageous conversions desired in the instant invention, although structures can be conceived, due to pore blockage or other cause, that may be operative.

Rather than attempt to judge from crystal structure whether or not a zeolite possesses the necessary constraint access, a simple determination of the "Constraint Index" may be made by continuously passing a mixture of equal weight of normal hexane and 3-methylpentane over a small sample, approximately 1 gram or less, of zeolite at atmospheric pressure according to the following procedure. A sample of the zeolite, in the form of pellets or extrudate, is crushed to a particle size about that of coarse sand and mounted in a glass tube. Prior to testing, the zeolite is treated with a stream of air at 1000° F. for at least 15 minutes. The zeolite is then flushed with helium and the temperature adjusted between 550° F. and 950° F. to give an overall conversion between 10% and 60%. The mixture of hydrocarbons is passed at 1 liquid hourly space velicity (i.e., 1 volume of liquid hydrocarbon per volume of catalyst per hour) over the zeolite with a helium dilution to give a helium to total hydrocarbon mole ratio of 4:1. After 20 minutes on stream, a sample of effluent is taken and analyzed, most conveniently by gas chromatography, to determine the fraction remaining unchanged for each of the two hydrocarbons.

The "Constraint Index" is calculated as follows:

$$\text{Constraint Index} = \frac{\log_{10}(\text{fraction of n-hexane remaining})}{\log_{10}(\text{fraction of 3-methylpentane remaining})}$$

The Constraint Index approximates the ratio of the cracking rate constants for the two hydrocarbons. Zeolites suitable for the present invention are those which have a Constraint Index from 1 to 12. Constraint Index (C.I.) values for some typical materials are:

| | |
|---|---|
| REY | 0.4 |
| H. Zeolon (mordenite) | 0.4 |
| ZSM-4 | 0.5 |
| Acid Mordenite | 0.5 |
| Beta | 0.6 |
| Amorphous Silica-Alumina | 0.6 |

-continued

| | |
|---|---|
| ZSM-12 | 2 |
| ZSM-38 | 2 |
| ZSM-48 | 3.4 |
| Clinoptilolite | 3.4 |
| TMA Offretite | 3.7 |
| ZSM-35 | 4.5 |
| ZSM-5 | 8.3 |
| ZSM-11 | 8.7 |
| ZSM-23 | 9.1 |
| Erionite | 38 |

The above-described Constraint Index is an important and even critical definition of those zeolites which are useful in the instant invention. The very nature of this parameter and the recited technique by which it is determined, however, admit of the possibility that a given zeolite can be tested under somewhat different conditions and thereby have different constraint indexes. Constraint Index seems to vary somewhat with severity of operation (conversion). Therefore, it will be appreciated that it may be possible to so select test conditions to establish multiple constraint indexes for a particular given zeolite which may be both inside and outside the above-defined range of 1 to 12.

Thus, it should be understood that the parameter and property "Constraint Index" as such value is used herein is an inclusive rather than an exclusive value. That is, a zeolite when tested by any combination of conditions within the testing definition set forth hereinabove to have a Constraint Index of 1 to 12 is intended to be included in the instant catalyst definition regardless that the same identical zeolite tested under other defined conditions may give a Constraint Index value outside of 1 to 12.

The members of the class of zeolites for use herein are exemplified by ZSM-5, ZSM-5/ZSM-11 intermediate, ZSM-11, ZSM-12, ZSM-23, ZSM-35, ZSM-38, ZSM-48 and other similar materials. U.S. Pat. No. 3,702,886 describing and claiming ZSM-5 is incorporated herein by reference. Also, Re. No. 29,948 describing and claiming a crystalline material with an X-ray diffraction pattern of ZSM-5, is incorporated herein by reference as is U.S. Pat. No. 4,061,724 describing a high silica ZSM-5 referred to as "silicate" in such patent.

The ZSM-5/ZSM-11 intermediate is described in U.S. Pat. No. 4,229,424. ZSM-11 is more particularly described in U.S. Pat. No. 3,709,979. ZSM-12 is more particularly described in U.S. Pat. No. 3,832,449. ZSM-23 is more particularly described in U.S. Pat. No. 4,076,842. ZSM-35 is more particularly described in U.S. Pat. No. 4,016,245. ZSM-38 is more particularly described in U.S. Pat. No. 4,046,859. The entire contents of the above identified patents are incorporated herein by reference. ZSM-48 is more particularly described in U.S. patent application Ser. No. 343,131 filed Jan. 27, 1982, the entire content of which are incorporated herein by reference.

Natural zeolites may sometimes be converted to this class of zeolites by various activation procedures and other treatments such as base exchange, steaming, alumina extraction and calcination, alone or in combinations. Natural minerals which may be so treated include ferrierite, brewsterite, stilbite, dachiardite, epistilbite, heulandite and clinoptilolite. The preferred zeolites of the additive catalyst are ZSM-5, ZSM-5/ZSM-11 intermediate, ZSM-11, ZSM-12, ZSM-23, ZSM-35, ZSM-38, and ZSM-48, with ZSM-5 particularly preferred.

The zeolites used in additive catalysts in this invention may be in hydrogen form or they may be base exchanged or impregnated to contain a rare earth cation complement. Such rare earth cations comprise Sm, Nd, Pr, Ce and La. It is desirable to calcine the zeolite after base exchange.

In a preferred aspect of this invention, the crystalline zeolites are selected as those having a crystal framework density, in the dry hydrogen form, of not substantially below about 1.6 grams per cubic centimeter. It has been found that zeolites which satisfy all three of these criteria are most desired. Therefore, the preferred crystalline zeolites for use in this invention are those having a Constraint Index as defined above of about 1 to 12, a silica to alumina mole ratio of at least about 12 and a dried crystal density of not substantially less than about 1.6 grams per cubic centimeter. The dry density for known structures may be calculated from the number of silicon plus aluminum atoms per 1000 cubic Angstroms, as given e.g., on page 19 of the article on *Zeolite Structure* by W. M. Meier. This paper is included in *Proceedings of the Conference on Molecular Sieves, Longon, April* 1967, published by the Society of Chemical Industry, London, 1968. When the crystal structure is unknown, the crystal framework density may be determined by classical pycnometer techniques. For example, it may be determined by immersing the dry hydrogen form of the zeolite in an organic solvent which is not sorbed by the crystal. It is possible that the unusual sustained activity and stability of this class of zeolites are associated with its high crystal anionic framework density of not less than about 1.6 grams per cubic centimeter. This high density, of course, must be associated with a relatively small amount of free space within the crystal, which might be expected to result in more stable structures. This free space, however, seems to be important as the locus of catalytic activity.

Crystal framework densities of some typical zeolites, including some which are not within the purview of this invention, are:

| Zeolite | Void Volume | Framework Density |
|---|---|---|
| Ferrierite | 0.28 cc/cc | 1.76 g/cc |
| Mordenite | .28 | 1.7 |
| ZSM-5, -11 | .29 | 1.79 |
| ZSM-12 | — | 1.8 |
| ZSM-23 | — | 2.0 |
| Dachiardite | .32 | 1.72 |
| L | .32 | 1.61 |
| Clinoptilolite | .34 | 1.71 |
| Laumontite | .34 | 1.77 |
| ZSM-4 (Omega) | .38 | 1.65 |
| Heulandite | .39 | 1.69 |
| P | .41 | 1.57 |
| Offretite | .40 | 1.55 |
| Levynite | .40 | 1.54 |
| Erionite | .35 | 1.51 |
| Gmelinite | .44 | 1.46 |
| Chabazite | .47 | 1.45 |
| A | .5 | 1.3 |
| Y | .48 | 1.27 |

The catalyst and separate additive composition for use in this invention may be prepared in various ways. They may be separately prepared in the form of particles such as pellets or extrudates, for example, and simply mixed in the required proportions. The particle size of the individual component particles may be quite small, for example from about 10 to about 150 microns, when intended for use in fluid bed operation, or they may be as large as up to about ½ inch for fixed bed operation. Or the components may be mixed as powders and formed into pellets or extrudate, each pellet containing both components in substantially the required proportions.

It is desirable to incorporate the zeolite component of the separate additive composition in a matrix. Such matrix is useful as a binder and imparts greater resistance to the catalyst for the severe temperature, pressure and velocity conditions encountered in many cracking processes.

Matrix materials include both synthetic and natural substances. Such substances include clays, silica and/or metal oxides. The latter may be either naturally occurring or in the form of gelatinous precipitates, sols or gels including mixtures of silica and metal oxides. Frequently, zeolite materials have been incorporated into naturally occurring clays, e.g. bentonite and kaolin.

A particularly advantageous form of the catalyst is an extruded pellet having a diameter of about 1–3 mm, made by mixing steamed zeolite crystals with $\alpha$-alumina in a proportion of about 2:1 and calcining the formed material to obtain an extrudate having a void fraction of about 30–40%, preferably about 36%.

In addition to the foregoing materials, the zeolite for use herein can be composited with a porous matrix material such as silica-alumina, silica-magnesia, silica-zirconia, silica-thoria, silica-beryllia, silica-titania, as well as ternary compositions such as silica-alumina-thoria, silica-alumina-zirconia, silica-alumina-magnesia and silica-magnesia-zirconia. The matrix can be in the form of a cogel. A mixture of clay in combination with silica or any of the above specified cogels to form a matrix is highly preferred.

In general, the crystalline zeolites of the catalyst and separate additive composition for use herein are ordinarily ion-exchanged either separately or, in the case of additive composition, in the final preparation of such additive composition, with a desired cation to replace alkali metal present in the zeolite as found naturally or as synthetically prepared. The exchange treatment is such as to reduce the alkali metal content to less than about 50% by weight of the original alkali metal contained in the zeolite as synthesized, usually 0.5 weight percent or less. The purpose of ion exchange is to substantially remove alkali metal cations which are known to be deleterious to cracking, as well as to introduce particularly desired catalytic activity by means of various cations used in the exchange medium. For the cracking operation described herein, preferred cations are hydrogen, ammonium, rare earth and mixtures thereof, with particular preference being accorded rare earth. Ion exchange is suitably accomplished by conventional contact of the zeolite with a suitable salt solution of the desired cation such as, for example, the sulfate, chloride or nitrate.

GENERAL PROCESS DESCRIPTION

Figure 2:
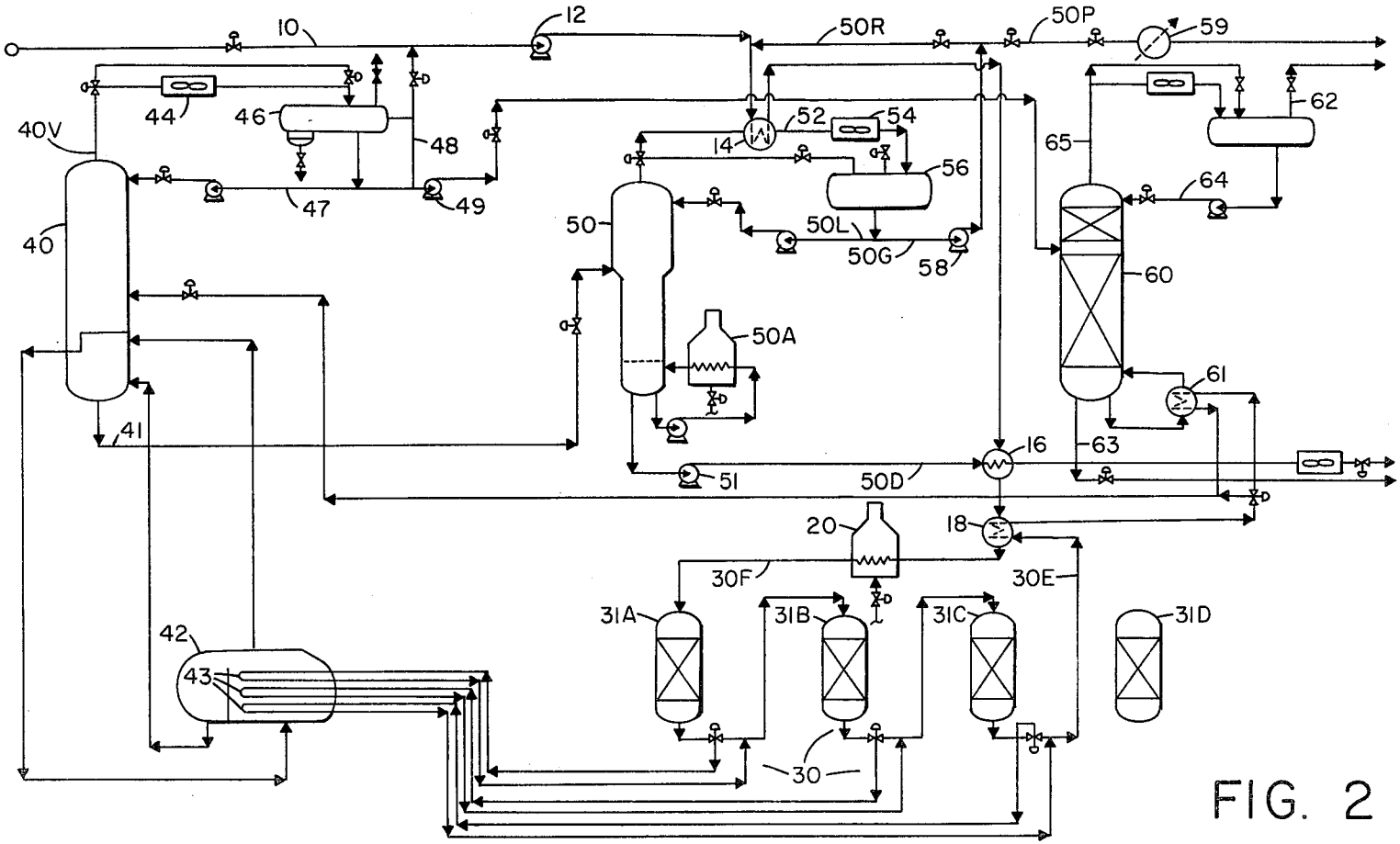
FIG. 2 is a schematic system diagram showing a process equipment and flow line configuration for a preferred embodiment.

Referring to FIG. 2, olefinic feedstock is supplied to the MOGD plant through liquid conduit 10 under steady stream conditions, diluted and pressurized to process pressure by pump 12. The olefinic feedstock plus recycled liquids are then sequentially heated by passing through indirect heat exchange units 14, 16, 18 and furnace 20 to achieve the temperature for catalytic conversion in reactor system 30, including plural reactor vessel 31A, B, C, etc.

The reactor system section shown consists of 3 downflow fixed bed, series reactors on line with exchanger cooling between reactors. The reactor configuration allows for any reactor to be in any position, A, B or C.

The reactor in position A has the most aged catalyst and the reactor in position C has freshly regenerated catalyst. The cooled reactor effluent is fractionated first in a debutanizer 40 to provide lower aliphatic liquid recycle and then in splitter unit 50 which not only separates the debutanizer bottoms into gasoline and distillate products but provides liquid gasoline recycle.

The gasoline recycle is not only necessary to produce the proper distillate quality but also (with the non-olefins in the feed and $C_3$–$C_4$ lower alkane recycle) limits the exothermic rise in temperature across each reactor to less than 30° C. However, the reactor $\Delta T$'s are also a function of the $C_3$–$C_4$ recycle flow rate. Change in recycle flow rate is intended primarily to compensate for gross changes in the feed non-olefin flow rate. As a result of preheat, the liquid recycles are substantially vaporized by the time that they reach the reactor inlet. The following is a description of the process flow in detail.

Olefin feedstock under flow control is combined in conduit 10 with condensed $C_3$–$C_4$ rich recycle, which is also under flow control. The resultant stream is pumped up to system pressure by pump 12 and is combined with gasoline recycle after that stream has been pumped up to system pressure by pump 58. The combined stream (feed plus recycle plus gasoline recycle) after preheat is routed to the inlet 30F of the reactor 31A of system 30. The combined stream (herein designated as the reactor feed stream) is first preheated against the splitter tower 50 overhead in exchanger 14 (reactor feed/splitter tower overhead exchanger) and then against the splitter tower bottoms in exchanger 16 (reactor feed/splitter bottoms exchanger) and then finally against the effluent from the reactor in position C, in exchanger 18 (reactor feed/reactor effluent exchanger). In the furnace 20, the reactor feed is heated to the required inlet temperature for the reactor in position A.

Because the reaction is exothermic, the effluents from the reactors in the first two positions A, B are cooled to the temperature required at the inlet of the reactors in the last two positions, B, C, by partially reboiling the debutanizer, 40. Temperature control is accomplished by allowing part of the reactor effluents to bypass the reboiler 42. Under temperature control of the bottom stage of the debutanizer, the additional required reboiling is provided by part of the effluent from the reactor 31 in position C.

After preheating the reactor feed, the reactor effluent reboils deethanizer bottoms 61 and is then routed as a mixed phase stream 80+% vapor to the debutanizer which is operated at a pressure which completely condenses the debutanizer tower overhead 40V by cooling in condenser 44. The liquid from debutanizer overhead accumulator 46 provides the tower reflux 47, the lower alkane recycle 48 and feed to the deethanizer 60, which, after being pumped to the deethanizer pressure by pump 49 is sent to the deethanizer 60. The deethanizer accumulator overhead 65 is routed to the fuel gas system 62. The accumulator liquid 64 provides the tower reflux. The bottoms stream 63 (LPG product) may be sent to an unsaturated gas plant or otherwise recovered.

The bottoms stream 41 from the debutanizer 40 is sent directly to the splitter, 50 which splits the $C_5$+ material into $C_5$–330° F. gasoline (overhead liquid product and recycle) and 330° F.+ distillate (bottoms product). The splitter tower overhead stream 52, after preheating the reactor feed stream is totally condensed in the splitter tower overhead condenser 54. The liquid from the overhead accumulator 56 provides the tower reflux 50L, the gasoline product 50P and the specified gasoline recycle 50R under flow control. For example, 1 mole gasoline/mole olefin in feed is pressurized by pump 58 for recycle. After being cooled in the gasoline product cooler 59, the gasoline product is sent to the gasoline pool. The splitter bottoms fraction is pumped to the required pressure by pump 51 and then preheats the reactor feed stream in exchanger 16. Finally, the distillate product 500 is cooled to ambient temperature before being hydrotreated to improve its cetane number.

From an energy conservation standpoint, it is advantageous to reboil the debutanizer using all three reactor effluents as opposed to using a fired reboiler. A kettle reboiler 42 containing 3 U-tube exchangers 43 in which the reactor 31 effluents are circulated is a desirable feature of the system. Liquid from the bottom stage of debutanizer 40 is circulated in the shell side. Alternatively three thermosyphon reboilers in series would suffer the disadvantages of a large pressure drop and control problems inherent in the instability resulting from the tower bottoms being successively vaporized in each reboiler. Although the pressure drop problem would be overcome with three reboilers in parallel, there would be considerable difficulty in controlling the allocation of tower bottoms to each parallel reboiler.

In order to provide the desired quality and rate for both liquid lower alkane ($C_3$–$C_4$) and gasoline recycles, it is necessary to fractionate the reactor effluent. Phase separators do not give the proper separation of the reactor effluent to meet the quality standards and rate for both liquid recycles. For example, the gasoline recycle would carry too much distillate and lights, while the $C_3$–$C_4$ recycle would contain gasoline boiling cuts. Consequently, it would be difficult to properly control the liquid recycles if separators were employed. In prior refinery practice, it was customary to deethanize a stream to remove very low molecular weight components prior to further fractionation to recover the $C_3$–$C_4$ gasoline and distillate streams. However, such prior practice would involve significantly greater equipment cost and poor energy conservation. It is a feature of the present system that the cooled reactor effluent is first fractionated in an efficient debutanizer unit to provide a condensed liquid stream rich in $C_3$–$C_4$ alkanes, part of which is recycled and part of which is deethanized to provide fuel gas and LPG product.

The deethanizer fractionation unit 60 may be a tray-type design or packed column, with about 13 to 18 theoretical stages being provided for optimum LPG product. With proper feedtray locations between 3 and 7 trays from the top, 15 theoretical stages in the deethanizer are adequate to assure proper fractionation.

The product splitter fractionation unit 50 receives the debutanizer bottoms, preferably as a mixed phase stream containing a major fraction of vapor (eg. 70 weight %) The main splitter column may be a tray-type or packed vertical fractionating column, with a furnace fixed bottoms reboiler 50A and gasoline reflux loop 14, 52, 54, 56, 50B. The fractionation equipment and operating techniques are substantially similar for each of the major stills 40, 50, 60, with conventional plate design, reflux and reboiler components. The fractionation sequence and heat exchange features of the present system and operative connection in an efficient MOGD system provide significant economic advantages.

psig). A typical material balance for distillate mode operation is given in Table I.

TABLE I

STREAM COMPONENTS
MOLE % - DISTILLATE MODE

| Component | Feedstock (Fresh Olefins) | Liquid $C_3$–$C_4$ Recycle | Gasoline Recycle/ Product | Reactor Feedstream | Reactor Effluent | Debu-tanizer Bottoms | Deethanizer Overhead | Deeth-anizer Reflux | Deethanizer Off-Gas (Fuel) | Deethanizer Bottoms (LPG) |
|---|---|---|---|---|---|---|---|---|---|---|
| | Stream | | | | | | | | | |
| $C_1$ | 0 | 0.27 | 0 | .04 | .12 | 0 | .76 | .32 | 3.39 | 0 |
| $C_2$= | .12 | .13 | 0 | .08 | .06 | 0 | .68 | .51 | 1.66 | 0 |
| $C_2$ | 1.04 | 2.52 | 0 | .88 | 1.15 | 0 | 16.54 | 13.95 | 32.08 | 0 |
| $C_3$= | 31.93 | 3.47 | 0 | 15.70 | 1.58 | 0 | 11.48 | 11.66 | 10.40 | 2.88 |
| $C_3$ | 11.98 | 29.92 | 0 | 10.25 | 13.61 | 0 | 61.12 | 63.16 | 48.9 | 28.27 |
| $iC_4$ | 17.61 | 40.34 | .22 | 14.60 | 18.46 | .20 | 7.26 | 7.99 | 2.85 | 43.54 |
| $C_4$= | 31.81 | 10.36 | .15 | 16.75 | 4.78 | .13 | 1.23 | 1.37 | .43 | 11.21 |
| $nC_4$ | 4.80 | 12.49 | .54 | 4.38 | 5.94 | .47 | .92 | 1.03 | .28 | 13.53 |
| $iC_5$ | .39 | .34 | 10.64 | 4.20 | 5.31 | 9.36 | 0 | 0 | 0 | .37 |
| $C_5$= | .30 | .17 | 9.56 | 3.72 | 4.65 | 8.4 | 0 | 0 | 0 | .18 |
| $nC_5$ | .01 | 0 | .52 | .20 | .25 | .46 | 0 | 0 | 0 | 0 |
| Gasoline | 0 | 0 | 75.38 | 28.08 | 36.3 | 66.62 | 0 | 0 | 0 | 0 |
| Distillate | 0 | 0 | 2.99 | 1.11 | 7.83 | 14.37 | 0 | 0 | 0 | 0 |
| $H_2O$ | .01 | 0 | 0 | .01 | .01 | 0 | 0 | 0 | 0 | 0 |
| Mass Flow | 100 | 33.3 | 160.4 | 293.7 | 293.7 | 212.6 | 21.3 | 18.5 | 2.8 | 45.1 |
| Stream No. (FIG. 2) | 10 | 48 | 50G | 30F | 30E | 41 | 65 | 64 | 62 | 63 |

MOGD operating modes may be selected to provide maximum distillate product by gasoline recycle and optimal reactor system conditions; however, it may be desired to increase the output of gasoline by decreasing or eliminating the gasoline recycle. Operating examples are given for both the distillate mode and gasoline mode of operation, utilizing as the olefinic feedstock a pressurized stream FCC olefinic effluent (about 1200 kPa) comprising a major weight and mole fraction of $C_3$=/$C_4$=, as set forth in Table I. The adiabatic exothermic oligomerization reaction conditions are readily optimized at elevated temperature and/or pressure to increase distillate yield or gasoline yield as desired, using H-ZSM-5 type catalyst. Particular process parameters such as space velocity, maximum exothermic temperature rise, etc. may be optimized for the specific oligomerization catalyst employed, olefinic feedstock and desired product distribution.

Distillate Mode Operations

A typical distillate mode multi-zone reactor system employs inter-zone cooling, whereby the reaction exotherm can be carefully controlled to prevent excessive temperature above the normal moderate range of about 190° to 315° C. (375°–600° F.).

Advantageously, the maximum temperature differential across any one reactor is about 30° C. ($\Delta T \sim 50°$ F.) and the space velocity (LHSV based on olefin feed) is about 0.5 to 1. Heat exchangers provide inter-reactor cooling and reduce the effluent to fractionation temperature. It is an important aspect of energy conservation in the MOGD system to utilize at least a portion of the reactor exotherm heat value by exchanging hot reactor effluent from one or more reactors with a fractionator stream to vaporize a liquid hydrocarbon distillation tower stream, such as the debutanizer reboiler. Optional heat exchangers may recover heat from the effluent stream prior to fractionation. Gasoline from the recycle conduit is pressurized by pump means and combined with feedstock, preferably at a mole ratio of about 1–2 moles per mole of olefin in the feedstock.

It is preferred to operate in the distillate mode at elevated pressure of about 4200 to 7000 kPa (600–1000

The mass flow rate relative to the major process streams for a preferred distillate-optimized MOGD plant are given in Table II, along with process temperature and pressure conditions. The mass flow rate at steady state is expressed in part by weight per 100 parts of fresh feed.

TABLE II

| Process Stream/No. | Mass Flow Rate | Tempera-ture (°C.) | Pressure kPa(a) (Kilo Pascals) absolute |
|---|---|---|---|
| Feedstock/10 | 100 | 38 | 1205 |
| $C_3$—$C_4$ recycle/48 | 33.3 | 43 | 1010 |
| Gasoline recycle/59 | 160.4 | 65 | — |
| Reactor feed/30F | 293.7 | 232/271* | 4200 |
| Reactor effluent/30E | 293.7 | 236/259* | 3686 |
| Debut. overhead/40V | 183.9 | 61 | 1050 |
| Debut. reflux/47 | 102.9 | — | 1015 |
| Debut. over. prod./48 | 81.1 | 43 | 1015 |
| Debut. bottoms/41 | 212.6 | 197 | 1100 |
| Deeth. feed/60F | 47.8 | 43 | 2140 |
| Deeth. overhead/65 | 21.3 | 58 | 2100 |
| Deeth. reflux/64 | 18.5 | 43 | — |
| Deeth. off gas/62 | 2.8 | 43 | 2070 |
| LPG Prod./63 | 45.1 | 91 | 2110 |
| Splitter overhead/52 | 196.6 | 124 | 160 |
| Splitter reflux/50B | 28.3 | 65 | 105 |
| Splitter Product/50G | 168.3 | 65 | 105 |
| Gasoline Product/50P | 8 | 43 | 790 |
| Distillate Product/50D | 44.3 | 43 | 970 |

*SOC/EOC

The gasoline product is recovered from this mode of operation at the rate of 8% of olefinic feedstock, whereas distillate is recovered at 44% rate. Product properties are shown in Table III.

TABLE III

PRODUCT PROPERTIES

| Properties | Gasoline $C_6$—330° F. | Distillate 330° F. + (RAW) |
|---|---|---|
| Gravity, °API | 62.8 | 48.5 |
| Total Sulfur, ppmw | 0 | 0 |
| Octane Number, R + O | 90 | — |
| Bromine Number | — | 78.9 |
| Weight % $H_2$ | — | 14.3 |
| Aniline Pt | — | 163 |
| Freeze Pt (°F.) | — | < −76 |
| Cetane Number | — | 33 |

TABLE III-continued

| PRODUCT PROPERTIES | | |
|---|---|---|
| Luminometer Number | — | 69 |
| ASTM Distillation | D-86 | D-1160 |
| IBP | 165 | 348 |
| 10/30 | 217/252 | 379/407 |
| 50/70 | 284/316 | 449/511 |
| 90 | 414 | 676 |
| 95 | — | 770 |
| EP | 531 | |

The reactor system contains multiple downflow adiabatic catalytic zones in each reactor vessel. The liquid hourly space velocity (based on total fresh feedstock) is about 1 LHSV. In the distillate mode the inlet pressure to the first reactor is about 4200 kPa (600 psig total), with an olefin partial pressure of at least about 1200 kPa. Based on olefin conversion of 50% for ethene, 95% for propene, 85% for butene-1 and 75% for pentene-1, and exothermic heat of reaction is estimated at 450 BTU per pound of olefins converted. When released uniformly over the reactor beds, a maximum $\Delta T$ in each reactor is about 30° C. In the distilate mode the molar recycle ratio for gasoline is equimolar based on olefins in the feedstock, and the $C_3$–$C_4$ molar recycle is 0.5:1.

From the olefinic feedstock, which contains about 62% olefins, the distillate mode operation described produces about 31 vol. % distillate along with about 6.3% gasoline, 6% LPG and 38+% unconverted olefins and saturated aliphatics in the feed.

Gasoline Mode Operation

By way of comparison, the distillate mode is compared with operation of the same system shown in FIG. 2, except that the reactor system is operated at relatively elevated temperature and moderate pressure with no gasoline recycle. The distillate yield is reduced to about 13 vol. % and the gasoline yield increased to about 27%.

The gasoline mode reactor is operated at the higher conversion temperature and does not require maximum differential temperature control closer than about 65° C. ($\Delta T \sim 120°$ F.) in the approximate elevated range of 230° to 375° C. (450°–700° F.). The reactor bed is maintained at a moderate superatmospheric pressure of about 400 to 3000 kPa (50–400 psig), and the space velocity for ZSM-5 catalyst to optimize gasoline production should be about 0.5 to 2 (LHSV). Preferably, all of the catalyst reactor zones in the system comprise a fixed bed down flow pressurized reactor having a porous bed of ZSM-5 type catalyst particles with an acid activity of about 160 to 200, identical with the distillate mode system for simplifying mode selection and cyclic operation.

By comparison with the distillate mode examples, the gasoline mode system is operated at the same velocity (LHSV=1, based on total fresh feed), maximum allowable temperature rise ($\Delta T \sim 28°$ C.), catalyst aging rates and elevated temperature (SOC=230° C. min., EOC=295° C. max.). Total reactor pressure is reduced to 2160 kPa (300 psig), with a minimum olefin partial pressure at reactor inlet of about 350 kPa (50 psia). In the gasoline mode the exothermic heat of reaction is reduced from 450 to 380 BTU/pound of olefins converted. Since the gasoline recycle is reduced from equimolar amounts with the olefins to nil, the $C_3$–$C_4$ recycle mol ratio is increased from about 0.5:1 to 2:1 to provide adequate diluent. Under the stated gasoline mode conditions ethylene conversion is about 50%, propene, 95%; butene-1, 85%; and pentene-1, 75%. On a weight percent basis the gasoline ($C_6$-330° F.) yield is 52.4% with 32% distillate (330° F.+), as compared to 12.6 weight % and 79%, respectively in the distillate mode.

Heat integration and fractionation techniques may be adapted to accommodate optional distillate or gasoline modes. The combined olefin/$C_3$–$C_4$ recycle feedstream may be preheated by debutanizer bottoms in an optional exchanger. Additional pump capacity may be required to handle increased recycle liquid.

Preferably the ZSM-5 catalyst is kept on stream until the coke content increases from 0% at the start of cycle (SOC) until it reaches a maximum of 30 weight % at end of cycle (EOC) at which time it is regenerated by oxidation of the coke deposits. Typically a 30-day total cycle can be expected between regenerations. The reaction operating temperature depends upon its serial position. The system is operated advantageously (as shown in FIG. 2) by increasing the operating temperature of the first reactor (Position A) from about 230°–255° C. (SOC) to about 270° C.–295° C. (EOC) at a catalyst aging rate of 3°–6° C./day. Reactors in the second and subsequent positions (B, C, etc.) are operated at the same SOC temperature; however, the lower aging rate (eg.—3° C./day) in continuous operation yields a lower EOC maximum temperature (eg.—about 275° C.), after about 7 days on stream. The end of cycle is signalled when the outlet temperature of the reactor in position A reaches its allowable maximum. At this time the inlet temperature is reduced to start of cycle levels in order to avoid excessive coking over the freshly regenerated catalyst when reactor 31D is brought on-line, after having been brought up to reaction pressure with an effluent slip stream.

Figure 3:
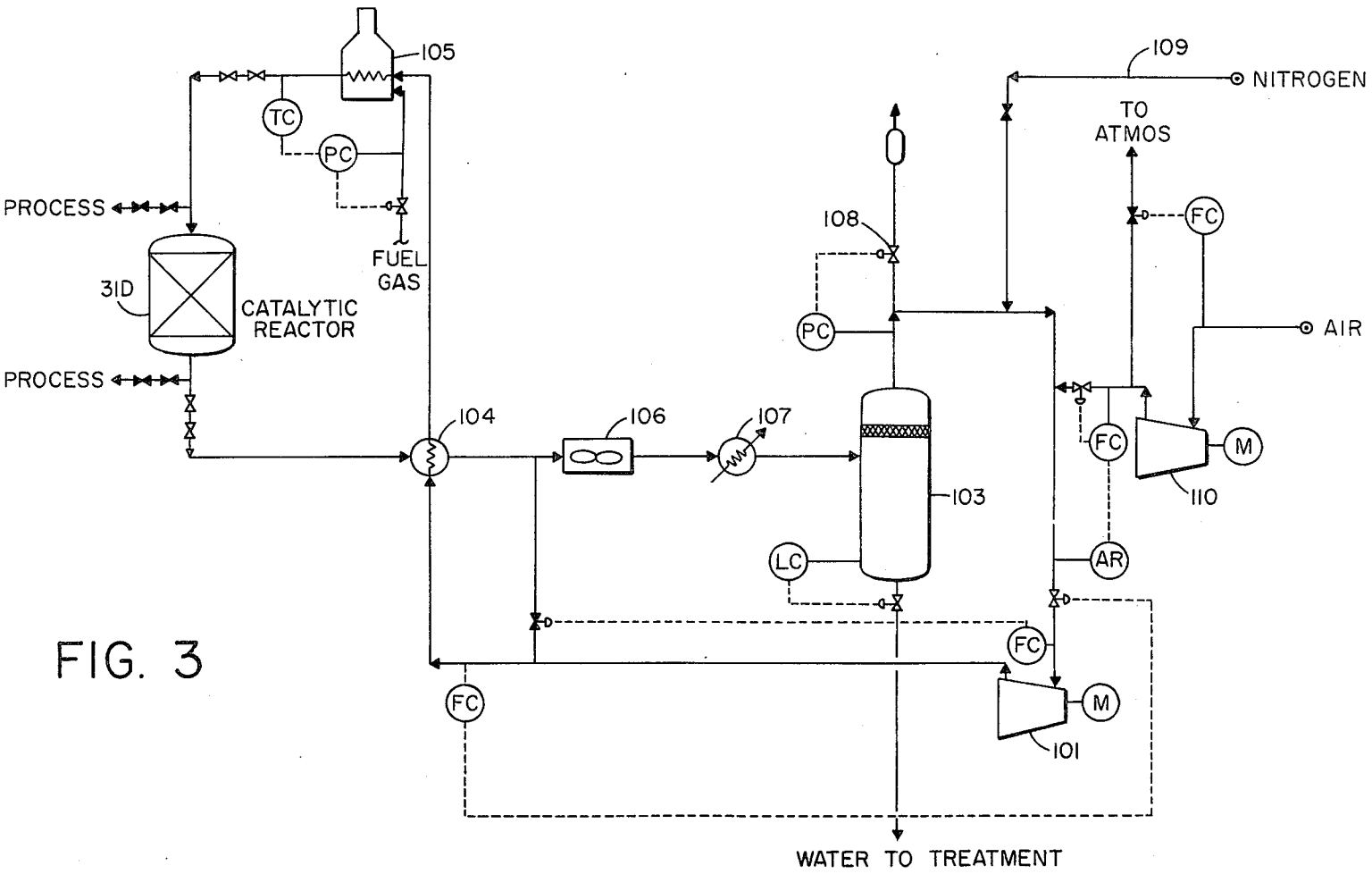
FIG. 3 is a schematic regeneration system diagram showing a typical reactor regeneration cycle.

Regeneration of coked catalyst may be effected by any of several procedures. The catalyst may be removed from the reactor of the regeneration treatment to remove carbonaceous deposits or the catalyst may be regenerated in-situ in the reactor. In FIG. 3, a typical regeneration subsystem is shown, wherein the off-stream fixed catalyst bed unit 31D is operatively connected with a source of oxidizing gas at elevated temperature. A programmable logic controller may be employed to control the sequencing of valve operations during all stages of reactor system operation.

The regeneration circuit includes a recycle gas compressor 101 which circulates the regeneration gas. This compressor takes suction from phase separator 103. The gas then passes through the feed/effluent heat exchanger 104 to the regeneration heater 105 and into reactor 31D. Here the catalyst is regenerated by burning off coke, producing $CO_2$ and $H_2O$. Reactor effluent is cooled in the feed/effluent exchanger 100 then in an air cooler 106 and is finally cooled in the trim cooler 107 before entering the separator 103. Gas is released from the separator to maintain system pressure through pressure-response venting means 108. By the time it reaches the separator, water vapor formed during the burn has condensed and is separated from the recycle gas. Because water vapor at high temperatures may damage the catalyst, separator temperature is maintained low (40°–50° C. at 800 kPa) in order to minimize the $H_2O$ partial pressure in the recycle gas returning to the reactor.

At the beginning of the regeneration the system is brought up to pressure with nitrogen with inert gas source 109, the reactor inlet temperature adjusted to about 370° C. and air is injected at the compressor suction by air make-up compressor 110 at a rate controlled to give a maximum oxygen concentration of 0.7% at the reactor inlet. As burning begins, a temperature rise of about 85° C. will be observed. As the burn dies off the inlet temperature is raised to maintain about 455° C. outlet temperature. When the main burn is completed, as evidenced by no temperature rise across the catalyst bed, the temperature is raised over 500° C. and the $O_2$ content to 7.0%. This condition is held at least one hour (or until all evidence of burning has ceased). When the regeneration is complete, the temperature is reduced and the system purged free of $O_2$ with nitrogen. The reactor is then blocked off from the regeneration loop and brought up to reaction pressure with a slip stream from the process reactor effluent line. To reconnect the regenerated reactor in the proper serial position in FIG. 2, reactor 31D is then paralleled with 31C. When full flow is established in the regenerated reactor in position C, reactor 31C is paralleled with 31B (currently in position B, i.e., receiving flow from the first reactor 31A, etc. Finally the fully coked catalyst bed in reactor 31A is blocked in, depressured, and repressured with nitrogen, then opened to the regeneration circuit, as unit 31D in FIG. 3. Thus each reactor will move from position C to position B to position A before being taken off-line for catalyst regeneration.

It is preferred to have at least three adiabatic reactors in continuous service; however, the $\Delta T$ becomes smaller with increased numbers of serial reactors and difficulties may be encountered in exploiting the reaction exotherm for reboiling the debutanizer unit and preheating reactor feed. A smaller number of serial reactors in the system would require much greater $C_3$–$C_4$ recycle to control the reaction exotherms from catalytic oligomerization.

Individual reactor vessels should be sized to accommodate the fixed catalyst bed with a normal pressure drop of about 100 kPa (15 psi) and total mass flow rate of about 3600 lbs/hr. -ft.$^2$. A typical vessel is constructed of steel or steel alloy to withstand process pressure up to about 70 atmospheres (7000 kPa) at maximum operating temperature. An enclosed cylindrical vessel with L/D ratio of about 2:1–10:1, preferably 4:1 to 6:1, is satisfactory. Since the reactor feed stream is completely vaporized or contains a minor amount of hydrocarbon liquid, no special feed distributor internal structure is required to obtain substantially uniform downward flow across the catalyst bed.

Alternative Design

Figure 4:
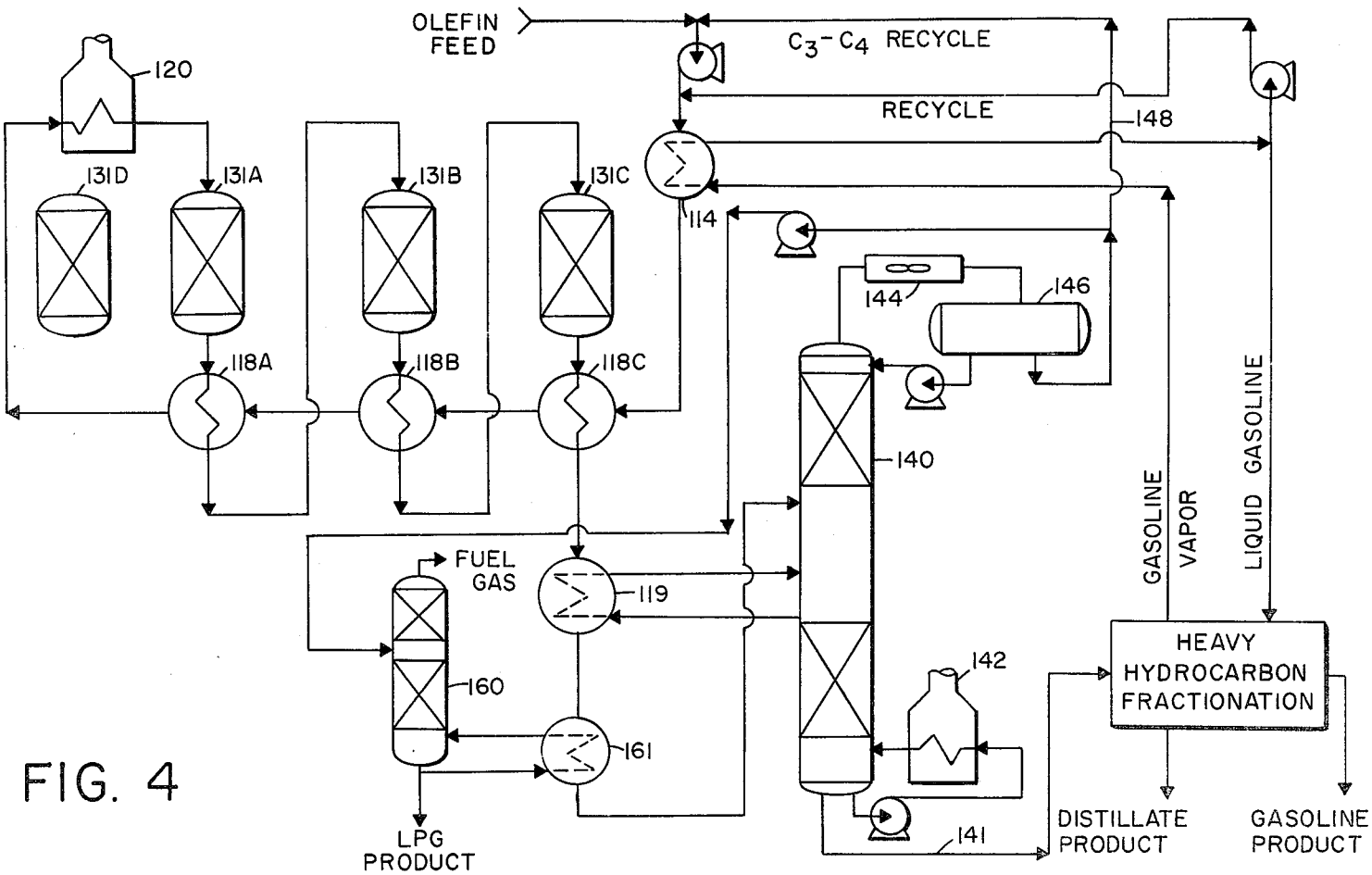
FIG. 4 is an alternative reactor system flow diagram.

An alternative technique for operating an MOGD plant is shown in FIG. 4, which employs $C_3$–$C_4$ recycle 148 for diluting the olefin feedstock. The combined reactor feedstream is heated indirectly by fractionator overhead gasoline vapor in exchanger unit 114 and passed sequentially through reactor effluent exchangers 118C, 118B, 118A and furnace 120 before entering catalytic reactors 131 A, B, C. Heat is exchanged between debutanizer 140 and hot reactor effluent in exchanger 119 to vaporize a lower tower fraction rich in $C_5$+ hydrocarbons. The debutanizer bottoms are withdrawn through $C_5$+ product line 141 and reboiled by furnace 142. Light gases from the debutanizer 140 are condensed in air cooler 144 and separated in accumulator 146 for reflux and recycle. A portion of the condensed light hydrocarbon stream is deethanized in tower 160 to provide fuel off gas and LPG product. The liquid from the bottom stage is reboiled by reactor effluent in exchanger 161 to recover additional heat values and to partially condense the heavier hydrocarbon in the effluent prior to debutanizing.

Figure 5:
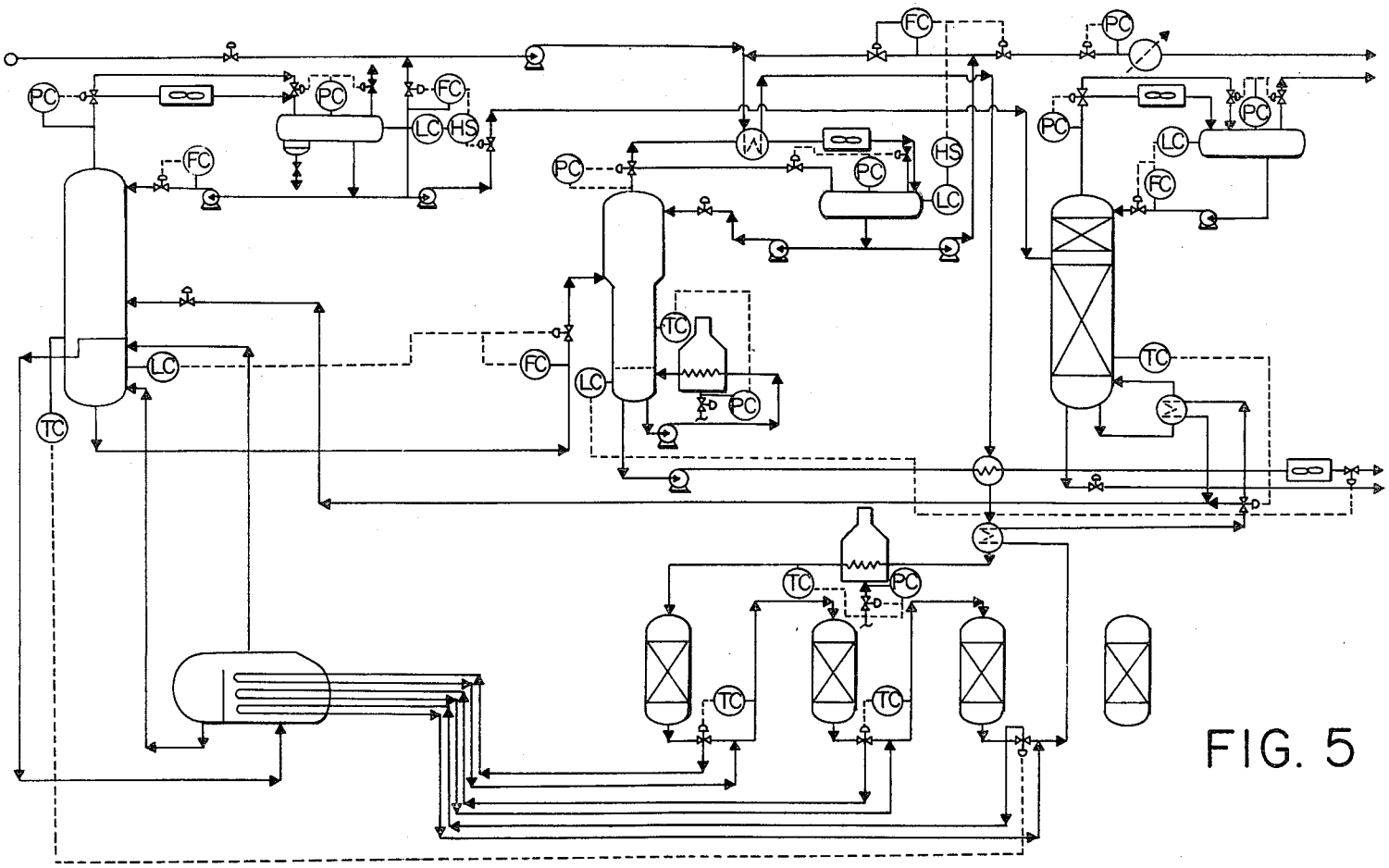
FIG. 5 is a flow diagram showing major process control functions.

A typical process control system is depicted in FIG. 5. This schematic instrumentation drawing shows the basic process units and interconnecting process flowlines of FIG. 2 in solid line. Control signal lines and instrument activating for process functions are depicted in dashed lines, with conventional instrumentation mode abbreviations. TC=temperature control; FC=flow control; LC=level control; PC=pressure control. These are general guidelines only and may be adapted to control requirements of any MOGD plant, including programmable digital control systems.

While the novel system has been described by reference to particular embodiments, there is no intent to limit the inventive concept except as set forth in the following claims.

What is claimed is:

1. A continuous process for converting lower olefins to higher hydrocarbons with optional operation to maximize either distillate or gasoline product comprising:

(a) combining a pressurized liquid olefinic feedstock containing a substantial fraction of lower olefins with a pressurized liquid low alkane stream comprising a major fraction of $C_3$–$C_4$ alkanes;

(b) pre-heating the combined olefinic stream and lower alkane stream to a temperature of at least about 230° C.;

(c) contacting the pre-heated combined olefinic stream with an acid ZSM-5 type catalyst in a pressure reactor zone to convert a major portion of the lower olefin fraction to $C_5$+ hydrocarbons in the gasoline boiling and distillate range;

(d) cooling the reactor effluent from step (c);

(e) debutanizing the cooled reactor effluent directly at less than reactor pressure to recover condensed lower alkane stream and a liquid $C_5$+ hydrocarbon stream, including heat exchanging the reactor effluent indirectly with the liquid $C_5$+ hydrocarbon stream in a debutanizer reboiler section;

(f) recycling and pumping to reactor pressure at least a portion of the condensed lower alkane stream to step (a); and (g) fractionating the $C_5$+ hydrocarbon stream to obtain a distillate product fraction and a gasoline-boiling range fraction.

2. The process of claim 1 wherein the olefinic feedstock consists essentially of $C_2$–$C_5$ aliphatic hydrocarbons containing a major fraction of monoalkenes in the essential absence of dienes or other deleterious materials.

3. The process of claim 2 wherein the olefinic feedstock contains about 50 to 75 mole % $C_3$–$C_5$ alkenes; wherein said pre-heated combined stream is contacted with the catalyst at a weight hourly space velocity of about 0.5 to 2; wherein said recycled lower alkane contains at least 80 mole % $C_3$–$C_4$ alkanes and is combined with olefinic feedstream at a mole ratio of about 0.5:1 to 2:1, based on olefin in fresh feed; and wherein said catalyst comprises HZSM-5.

4. The process of claim 1 wherein said pressure reactor zone comprises a plurality of operatively-connected catalytic reactors arranged in multi-stage serial flow, with interstage cooling of reactor effluent in the debutanizer reboiler section.

5. The process of claim 4 wherein the debutanizer reboiler section comprises a plurality of reactor effluent cooling tubes combined in a common kettle type reboiler shell.

6. The process of claim 1 wherein at least a portion of the condensed lower alkane stream from debutanizing step (e) is further fractionated to provide a de-ethanized LPG product, and wherein at least a portion of olefinic gasoline fraction is recycled from step (g) to step (a).

7. In the continuous process for converting lower olefinic hydrocarbons to $C_5$+ liquid hydrocarbons by contacting olefinic feedstock with acid zeolite catalyst in the presence of a recycled diluent stream rich in $C_3$–$C_4$ hydrocarbons in an enclosed reactor at elevated temperature and pressure, the improvement which comprises:

cooling reactor effluent to recover a heavier hydrocarbon stream containing a mixture of $C_3$–$C_4$ hydrocarbons and $C_5$+ hydrocarbons, debutanizing said heavier hydrocarbon stream reactor effluent in a debutanizer tower operated below reactor pressure to obtain a $C_5$+ liquid product stream and a condensed $C_3$–$C_4$ hydrocarbon stream;

exchanging heat between the $C_5$+ liquid debutanizer stream and hot reactor effluent;

recycling and combining at least a portion of the condensed $C_3$–$C_4$ hydrocarbon stream to dilute liquid olefin hydrocarbon feedstock; and increasing pressure on the liquid olefinic hydrocarbon feedstock and liquid recycle stream to at least the elevated reactor pressure in the liquid state prior to vaporization.

8. In the process for producing liquid hydrocarbons according to claim 7, the improvement which further comprises:

fractionating the $C_5$+ product stream to recover a gasoline stream containing olefins and a distillate stream.

9. In the process for producing liquid hydrocarbons according to claim 8, the further improvement which comprises:

recycling a portion of the olefinic gasoline stream for combining with liquid olefinic feedstock and $C_3$–$C_4$ diluent to further react olefinic gasoline components at elevated pressure and moderate temperature to increase distillate yield.

10. In the process for producing liquid hydrocarbons according to claim 8, the further improvement which comprises recovering substantially all gasoline range hydrocarbons from the process as product without substantial recycle thereof and operating the catalytic reactor at elevated temperature and moderate pressure to increase gasoline yield.

11. In the process for producing liquid hydrocarbons according to claim 7, further improvement which comprises:

contacting the feedstock with zeolite catalyst having a silica to alumina mole ratio of at least 12 and a Constraint Index of about 1 to 12.

12. In the process for producing liquid hydrocarbons according to claim 7, the improvement which further comprises:

operating said process in a maximum gasoline production mode.

* * * * *